US007581711B2

(12) United States Patent
Akabane

(10) Patent No.: US 7,581,711 B2
(45) Date of Patent: Sep. 1, 2009

(54) ELECTROMAGNETIC FUEL INJECTION VALVE

(75) Inventor: Akira Akabane, Miyagi (JP)

(73) Assignee: Keihin Corporation, Tokyo (JP)

( * ) Notice: Subject to any disclaimer, the term of this patent is extended or adjusted under 35 U.S.C. 154(b) by 436 days.

(21) Appl. No.: 11/579,386

(22) PCT Filed: Oct. 6, 2005

(86) PCT No.: PCT/JP2005/010652

§ 371 (c)(1),
(2), (4) Date: Nov. 2, 2006

(87) PCT Pub. No.: WO2005/124143

PCT Pub. Date: Dec. 29, 2005

(65) Prior Publication Data

US 2008/0290305 A1 Nov. 27, 2008

(30) Foreign Application Priority Data

Jun. 16, 2004 (JP) ..... 2004-178780

(51) Int. Cl.
*F02M 51/00* (2006.01)

(52) U.S. Cl. ..... 251/129.21; 335/279

(58) Field of Classification Search ..... 251/129.21, 251/129.15; 239/585.1, 585.4, 585.5; 335/279
See application file for complete search history.

(56) References Cited

U.S. PATENT DOCUMENTS

| | | | | |
|---|---|---|---|---|
| 5,769,391 | A * | 6/1998 | Noller et al. | 251/129.21 |
| 5,944,262 | A * | 8/1999 | Akutagawa et al. | 239/585.4 |
| 6,045,116 | A * | 4/2000 | Willke et al. | 251/129.21 |
| 6,201,461 | B1 * | 3/2001 | Eichendorf et al. | 335/256 |
| 6,601,786 | B2 * | 8/2003 | Yamaguchi et al. | 239/585.4 |
| 6,616,073 | B2 * | 9/2003 | Sugiyama | 239/585.1 |
| 6,702,253 | B2 * | 3/2004 | Noller et al. | 251/129.21 |

FOREIGN PATENT DOCUMENTS

| | | |
|---|---|---|
| JP | 7-189852 A | 7/1995 |
| JP | 2000-8990 A | 1/2000 |

* cited by examiner

*Primary Examiner*—John Bastianelli
(74) *Attorney, Agent, or Firm*—Arent Fox LLP

(57) ABSTRACT

An electromagnetic fuel injection valve having a cylindrical magnetic body, the front end of a cylindrical non-magnetic body surrounding a part of a movable core coaxially connected to a valve body is connected coaxially to the rear end of the cylindrical magnetic body, and a fixed core is fitted into and fixed to a rear portion of the cylindrical non-magnetic body, wherein the movable core includes a tubular sliding portion having an outer peripheral face that is in sliding contact with an inner peripheral face of a rear portion of the cylindrical magnetic body, a rear tubular opposing portion, and a front tubular opposing portion, and when the diameter of the rear tubular opposing portion is D1, the diameter of the front tubular opposing portion is D2, and the diameter of the tubular sliding portion is D3, they are set so that D1<D2<D3.

5 Claims, 2 Drawing Sheets

ELECTROMAGNETIC FUEL INJECTION VALVE

CROSS-REFERENCE TO RELATED APPLICATION

This application is a National Stage entry of International Application No. PCT/JP2005/010652, filed Jun. 10, 2005, the entire specification claims and drawings of which are incorporated herewith by reference.

TECHNICAL FIELD

The present invention relates to an electromagnetic fuel injection valve that includes a valve housing formed from a valve seat member having a valve seat and a cylindrical magnetic body having a front end thereof coaxially connected to the valve seat member, a valve assembly formed from a valve body housed in the valve housing so that the valve body can be seated on the valve seat and a movable core coaxially connected to the valve body with the rear end face of the movable core as a movable side attracting face, the valve assembly being spring-biased in a direction that seats the valve body on the valve seat, a cylindrical non-magnetic body having the front end thereof coaxially joined to the rear end of the cylindrical magnetic body so as to surround a part of the movable core, and a fixed core that has at a front end thereof a fixed side attracting face facing the movable side attracting face and has a front portion thereof fitted into and fixed to a rear portion of the cylindrical non-magnetic body.

BACKGROUND ART

Such an electromagnetic fuel injection valve is already known form, for example, Patent Document 1.

Patent Document 1:

Japanese Patent Application Laid-open No. 2000-8990

DISCLOSURE OF THE INVENTION

Problem To Be Solved By the Invention

However, in the above-mentioned conventional arrangement, the movable core is provided with an annular sliding-contact projection, which is in sliding contact with an inner face of the cylindrical non-magnetic body, a side gap between the cylindrical magnetic body and the movable core is relatively large, it cannot be said that the efficiency with which magnetic flux is passed is excellent, and it cannot be said that the valve-opening responsiveness is excellent.

The present invention has been accomplished under the above-mentioned circumstances, and it is an object thereof to provide an electromagnetic fuel injection valve that has enhanced efficiency in passing magnetic flux between a movable core and a cylindrical magnetic body and an improved valve-opening responsiveness.

Means For Solving the Problem

In order to attain these objects, in accordance with a first aspect of the present invention, there is provided an electromagnetic fuel injection valve comprising: a valve housing comprising a valve seat member having a valve seat and a cylindrical magnetic body having a front end thereof coaxially connected to the valve seat member; a valve assembly comprising a valve body housed in the valve housing so that the valve body can be seated on the valve seat and a movable core coaxially connected to the valve body with a rear end face of the movable core as a movable side attracting face, the valve assembly being spring-biased in a direction that seats the valve body on the valve seat; a cylindrical non-magnetic body having the front end thereof coaxially joined to the rear end of the cylindrical magnetic body so as to surround a part of the movable core; and a fixed core having at a front end thereof a fixed side attracting face facing the movable side attracting face and having a front portion thereof fitted into and fixed to a rear portion of the cylindrical non-magnetic body; characterized in that the movable core comprises a tubular sliding portion having an outer peripheral face that is in sliding contact with an inner peripheral face of a rear portion of the cylindrical magnetic body over a predetermined length along the axis of the cylindrical magnetic body, a rear tubular opposing portion that has the movable side attracting face at a rear end thereof, is connected coaxially and integrally to the rear end of the tubular sliding portion, and has the outer periphery thereof facing the inner periphery of the cylindrical magnetic body, and a front tubular opposing portion that has the outer periphery thereof facing the inner periphery of the cylindrical magnetic body and is connected coaxially and integrally to the front end of the tubular sliding portion, and when the diameter of the rear tubular opposing portion is D1, the diameter of the front tubular opposing portion is D2, and the diameter of the tubular sliding portion is D3, they are set so that $D1<D2<D3$.

Further, in addition to the arrangement of the first aspect, in accordance with a second aspect of the present invention, there is provided an electromagnetic fuel injection valve, wherein the predetermined length is set to be equal to or less than 1 mm.

In addition to the arrangement of the first or second aspect, in accordance with a third aspect of the present invention, there is provided an electromagnetic fuel injection valve, wherein the diameter D1 of the rear tubular opposing portion, the diameter D2 of the front tubular opposing portion, and the diameter D3 of the tubular sliding portion are set so as to satisfy $(D3-D2)/(D3-D1)\leqq 0.5$.

In addition to the arrangement of any one of the first to third aspect, in accordance with a fourth aspect of the present invention, there is provided an electromagnetic fuel injection valve, wherein the movable side attracting face is formed at the rear end of the rear tubular opposing portion at substantially right angles to the outer peripheral face of the rear tubular opposing portion, and when the diameter of the fixed side attracting face is D4, it is set so that $D1\leqq D4$.

Furthermore, in addition to the arrangement of any one of the first to fourth aspect, in accordance with a fifth aspect of the present invention, there is provided an electromagnetic fuel injection valve, wherein the movable core and the valve body are formed integrally from a high hardness ferrite magnetic material, the cylindrical magnetic body is formed from a high hardness ferrite magnetic material, and a journal portion provided in the valve body is slidably fitted into an inner peripheral face of the valve seat member

Effect of the Invention

In accordance with the arrangement of the first aspect of the present invention, since the tubular sliding portion of the movable core is in sliding contact with the inner peripheral face of the cylindrical magnetic body over the predetermined length along the axis of the cylindrical magnetic body, a side gap between the movable core and the cylindrical magnetic body becomes substantially '0' in part and, furthermore, since the diameter D1 of the rear tubular opposing portion, which forms part of the movable core so that the outer periphery of the rear tubular opposing portion faces the inner periphery of the cylindrical non-magnetic body, is smaller than the diameter D2 of the front tubular opposing portion, which forms part of the movable core so that the outer periphery of the front tubular opposing portion faces the inner periphery of the cylindrical magnetic body, it is possible to enhance the efficiency of passing magnetic flux between the movable core and the cylindrical magnetic body and improve the valve-opening responsiveness.

Furthermore, in accordance with the arrangement of the second aspect of the present invention, the tubular sliding portion is in sliding contact with the inner peripheral face of the rear portion of the cylindrical magnetic body over the relatively short length of equal to or less than 1 mm, thereby reducing to a low level the magnetic holding power generated between the cylindrical magnetic body and the movable core after stopping energization, and it is thus possible to avoid a deterioration in the valve-closing responsiveness. Moreover, the length of the front tubular opposing portion is made relatively long, thus making it easy to maintain a constant side gap between the front tubular opposing portion and the cylindrical magnetic body, and it is thereby possible to prevent variations in individual performance from being caused and to avoid as far as possible variations in the side gap affecting the valve-closing responsiveness.

In accordance with the arrangement of the third aspect of the present invention, the distance between the front tubular opposing portion and the cylindrical magnetic body is set to be no more than half the distance between the rear tubular opposing portion and the cylindrical non-magnetic body so that the outer periphery of the front tubular opposing portion is made closer to the inner periphery of the cylindrical magnetic body, and it is thereby possible to yet further enhance the valve-opening responsiveness.

In accordance with the arrangement of the fourth aspect of the present invention, the magnetic flux can be passed between the fixed core and the movable core efficiently even when the axis of the movable core is eccentric to the axis of the fixed core, thus utilizing the area of the movable side attracting face effectively and thereby enhancing the attracting force with which the movable core is attracted to the fixed core.

Moreover, in accordance with the arrangement of the fifth aspect of the present invention, since the integral movable core and valve body and the cylindrical magnetic body are formed from a high hardness ferrite magnetic material, it is unnecessary to subject the movable core and the cylindrical magnetic body to a surface treatment such as chromium plating, and no non-magnetic film that would be formed by the surface treatment is formed; it is therefore possible to yet further enhance the efficiency with which the magnetic flux is passed between the movable core and the cylindrical magnetic body, enhance the attracting force for the movable core, and markedly improve the valve-opening responsiveness, and this is advantageous in terms of production cost. Moreover, since the valve assembly is in sliding contact at two axially separated positions with the valve seat member and the cylindrical magnetic body, which form the valve housing, it is possible to prevent as far as possible the axis of the valve assembly from tilting within the valve housing, thus enabling a small and substantially uniform side gap to be set along the entire periphery between the movable core and the cylindrical magnetic body, the efficiency of passing the magnetic flux to be enhanced, and the valve-opening responsiveness to be improved.

DESCRIPTION OF THE REFERENCE NUMERALS AND CHARACTERS

Figure 1:
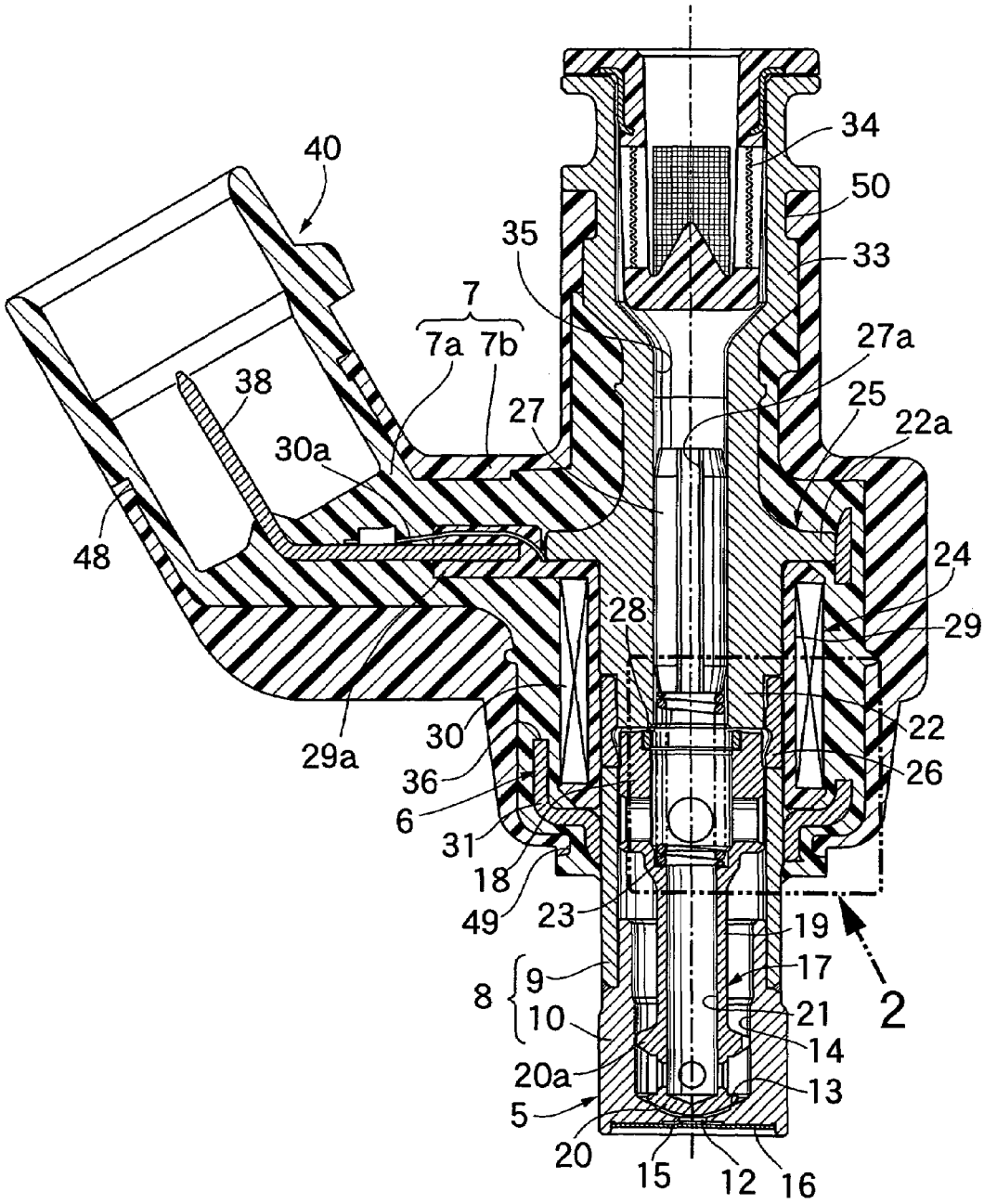
FIG. 1 is a vertical sectional view of an electromagnetic fuel injection valve (first embodiment).

8 valve housing
9 cylindrical magnetic body
10 valve seat member
13 valve seat
17 valve assembly
18 movable core
18*a* tubular sliding portion
18*b* rear tubular opposing portion
18*c* front tubular opposing portion
20 valve body
20*a* journal portion
22 fixed core
26 cylindrical non-magnetic body
41 movable side attracting face
42 fixed side attracting face

BEST MODE FOR CARRYING OUT THE INVENTION

A mode for carrying out the present invention is explained below by reference to one embodiment of the present invention shown in the attached drawings.

Embodiment 1

One embodiment of the present invention is explained by reference to FIG. 1 and FIG. 2; firstly in FIG. 1 an electromagnetic fuel injection valve for injecting fuel into an engine (not illustrated) includes a valve section 5 in which a valve body 20 is housed within a valve housing 8 having a valve seat 13 at the front end thereof, the valve body 20 being spring-biased in a direction that seats the valve body 20 on the valve seat 13, a solenoid section 6 in which a coil assembly 24 is housed in a solenoid housing 25 provided so as to be connected to the valve housing 8, the coil assembly 24 being capable of exhibiting an electromagnetic force for operating the valve body 20 so as to make it separate from the valve seat 13, and a synthetic resin covering section 7 having an integral coupler 40, connecting terminals 38 connected to a coil 30 of the coil assembly 24 facing the coupler 40, and at least the coil assembly 24 and the solenoid housing 25 being embedded in the covering section 7.

The valve housing 8 is formed from a cylindrical magnetic body 9 made of a magnetic metal and a valve seat member 10 that is joined in a liquid-tight manner to the front end of the cylindrical magnetic body 9. The valve seat member 10 is welded to the cylindrical magnetic body 9 in a state in which a rear end portion of the valve seat member 10 is fitted into a front end portion of the cylindrical magnetic body 9, and this valve seat member 10 is coaxially provided with a fuel outlet hole 12 opening on the front end face thereof, a tapered valve seat 13 connected to the inner end of the fuel outlet hole 12, and a guide hole 14 connected to a large diameter portion at the rear end of the valve seat 13 so as to guide the valve body 20. An injector plate 16 made of a steel plate is welded in a liquid-tight manner along its entire periphery to the front end of the valve seat member 10, the injector plate 16 having a plurality of fuel injection holes 15 communicating with the fuel outlet hole 12.

The solenoid section 6 includes a movable core 18, a cylindrical fixed core 22 facing the movable core 18, a return spring 23 exhibiting a spring force that urges the movable core 18 away from the fixed core 22, a coil assembly 24 disposed so as to surround a rear portion of the valve housing 8 and the fixed core 22 while being capable of exhibiting an electromagnetic force that allows the movable core 18 to be attracted to the fixed core 22 side against the spring force of the return spring 23, and a solenoid housing 25 surrounding the coil assembly 24 so that a front end portion of the solenoid housing 25 is connected to the valve housing 8.

The movable core 18 is slidably fitted into the rear portion within the valve housing 8, and the movable core 18 is coaxially connected to the valve body 20, which can be seated on the valve seat 13 so as to block the fuel outlet hole 12, thus forming a valve assembly 17. In this embodiment, the valve assembly 17 is formed from the movable core 18, a valve shaft 19 connected integrally to the movable core 18, and the valve body 20 formed integrally with the front end of the valve shaft 19, a through hole 21 is formed coaxially in this valve assembly 17, the through hole 21 communicating with the interior of the valve housing 8 and having a bottomed shape with its front end blocked, and the valve assembly 17 is urged by the return spring 23 in a direction that seats the valve body 20 on the valve seat 13.

Figure 2:
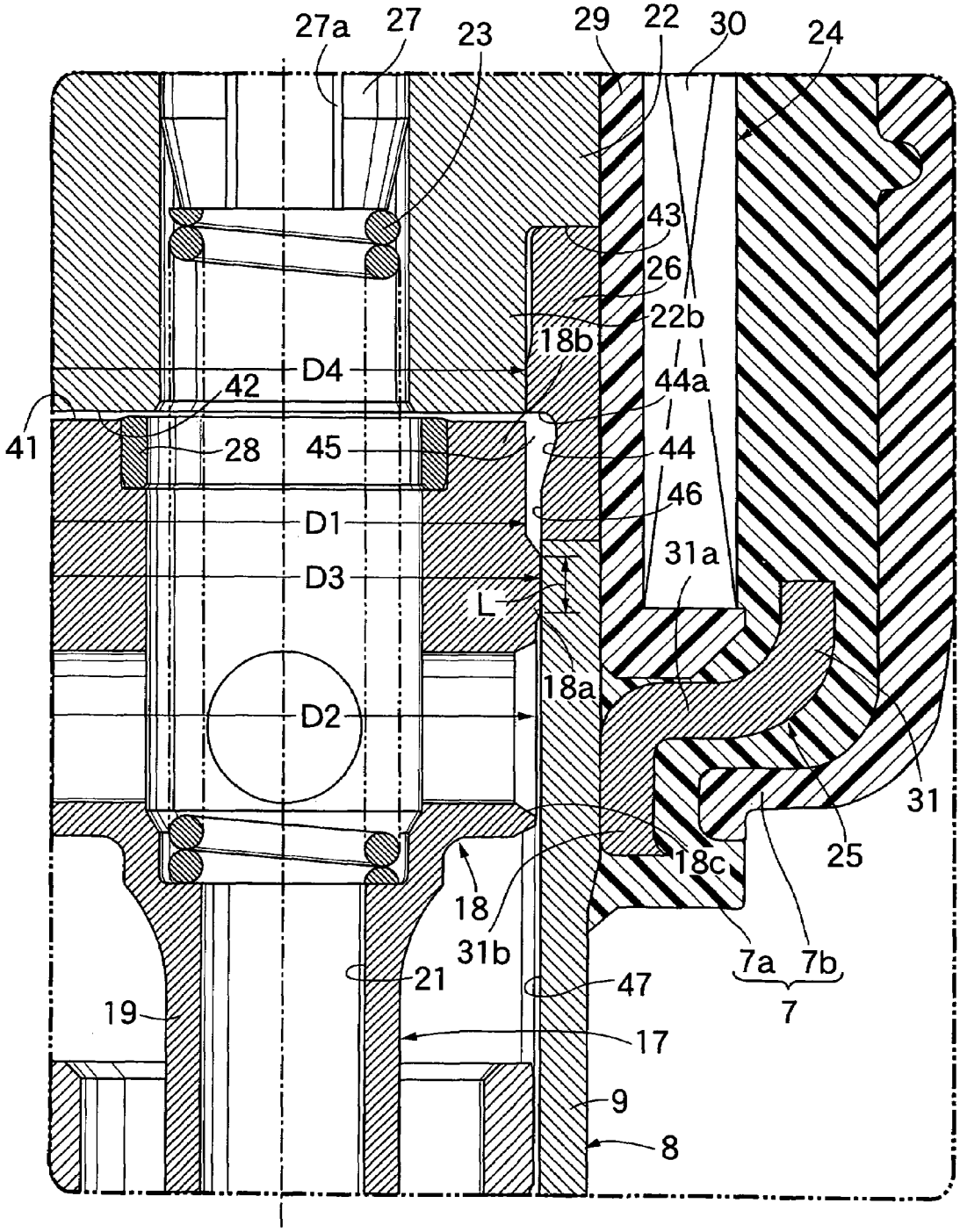
FIG. 2 is an enlarged view of a part shown by arrow 2 in FIG. 1 (first embodiment).

Referring in addition to FIG. 2, the rear end of the cylindrical magnetic body 9 of the valve housing 8 is coaxially joined to the front end of the fixed core 22 via a cylindrical non-magnetic body 26, which is made of a non-magnetic material or a material that is more weakly magnetic than that of the fixed core 22, that is, a non-magnetic metal such as stainless steel in this embodiment, the rear end of the cylindrical magnetic body 9 is butt-welded to the front end of the cylindrical non-magnetic body 26, and the rear end of the cylindrical non-magnetic body 26 is welded to the fixed core 22 in a state in which a front end portion of the fixed core 22 is fitted into the cylindrical non-magnetic body 26.

A tubular retainer 27 is coaxially press-fitted into the fixed core 22, the tubular retainer 27 having one slit 27*a* extending in the axial direction and having a substantially C-shaped cross-section, and the return spring 23 is disposed between the retainer 27 and the movable core 18. In order to avoid the movable core 18 from being in direct contact with the fixed core 22, a ring-shaped stopper 28 made of a non-magnetic material is press-fitted into the inner periphery of a rear end portion of the movable core 18 so that the ring-shaped stopper 28 projects slightly from a rear end face of the movable core 18 toward the fixed core 22. Furthermore, the coil assembly 24 is formed by winding a coil 30 around a bobbin 29 surrounding a rear portion of the valve housing 8, the cylindrical non-magnetic body 26, and the fixed core 22.

The solenoid housing 25 is formed from a cylindrical magnetic frame 31 and a flange portion 22*a*, the cylindrical magnetic frame 31 being made of a magnetic metal in a cylindrical shape having at one end thereof an annular end wall 31*a* facing an end portion of the coil assembly 24 on the valve section 5 side and surrounding the coil assembly 24, the flange portion 22*a* protruding radially outward from a rear end portion of the fixed core 22 and facing an end portion of the coil assembly 24 on the side opposite to the valve section 5, and the flange portion 22*a* being magnetically coupled to the other end portion of the magnetic frame 31. Moreover, a tubular mating portion 31*b* is coaxially provided on the inner periphery of the end wall 31*a* of the magnetic frame 31, the cylindrical magnetic body 9 of the valve housing 8 being fitted into the tubular mating portion 31*b*, and the solenoid housing 25 is provided so as to be connected to the valve housing 8 by fitting the valve housing 8 into the tubular mating portion 31*b*.

A cylindrical inlet tube 33 is integrally and coaxially connected to the rear end of the fixed core 22, and a fuel filter 34 is mounted on a rear portion of the inlet tube. 33. Moreover, a fuel passage 35 is coaxially provided in the inlet tube 33, the retainer 23, and the fixed core 22, the fuel passage 35 communicating with the through hole 21 of the movable core 18.

The covering section 7 is formed so as to embed not only the solenoid housing 25 and the coil assembly 24 but also a part of the valve housing 8 and a majority of the inlet tube 33 while filling in a gap between the solenoid housing 25 and the coil assembly 24, and a cutout portion 36 is provided in the magnetic frame 31 of the solenoid housing 25, the cutout portion 36 allowing an arm portion 29*a* formed integrally with the bobbin 29 of the coil assembly 24 to be disposed outside the solenoid housing 25.

The coupler 40 is provided integrally with the covering section 7, the connecting terminals 38 connected to opposite ends of the coil 30 of the coil assembly 24 facing the coupler 40, the base end of the connecting terminal 38 being embedded in the arm portion 29*a*, and coil ends 30*a* of the coil 30 being welded to the connecting terminals 38.

The covering section 7 is formed from a first resin molded layer 7*a* covering the solenoid housing 25 and forming part of the coupler 40, and a second resin molded layer 7*b* covering the first resin molded layer 7*a*. The first resin molded layer 7*a* on the extremity side relative to a middle portion of the coupler 40 is not covered by the second resin molded layer 7*b* but exposed to the outside, a rear portion of the inlet tube 33 is not covered by the second resin molded layer 7*b* but exposed to the outside and, furthermore, a portion of the first resin molded layer 7*a* corresponding to a rear portion of the valve housing 8 is not covered by the second resin molded layer 7*b* but exposed to the outside. Endless engagement channels 48 and 49 are formed in portions of the first resin molded layer 7*a* corresponding to the middle portion of the coupler 40 and the rear portion of the valve housing 8, end portions of the second resin molded layer 7*b* being engaged with the engagement channels 48 and 49, and an endless engagement channel 50 is provided on the outer periphery of a middle portion of the inlet tube 33, an end portion of the second resin molded layer 7*b* being engaged with the engagement channel 50. That is, the end portions of the second covering section 7*b* are made to interlock with the first covering section 7*a* and the inlet tube 33 via concavo-convex engagement.

In FIG. 2, the front end of the cylindrical non-magnetic body 26 is coaxially joined by butt-welding to the rear end of the cylindrical magnetic body 9 of the valve housing 8 so as to surround a part of the movable core 18, which has a rear end face thereof as a movable side attracting face 41, and a front portion of the fixed core 22, which has a front end face thereof as a fixed side attracting face 42, is fitted into and fixed to a rear portion of the cylindrical non-magnetic body 26 so that the fixed side attracting face 42 faces the movable side attracting face 41.

The front portion of the fixed core 22 is coaxially provided with a small diameter mating portion 22*b* forming, on the outer peripheral side, an annular step portion 43 facing forward so that the front end of the small diameter mating portion 22*b* forms the fixed side attracting face 42, and this small diameter mating portion 22*b* is fitted into the rear portion of the cylindrical non-magnetic body 26 until the. step portion 43 abuts against the rear end of the cylindrical non-magnetic body 26 while a portion of the small diameter mating portion 22*b* corresponding to the fixed side attracting face 42 is in intimate contact with the inner periphery of a middle portion of the cylindrical non-magnetic body 26, and in this state the fixed core 22 is fixed by welding to the cylindrical non-magnetic body 26.

Moreover, provided on the inner face of the cylindrical non-magnetic body 26 is an annular depression 44 having a flat portion 44*a* that is flush with the outer periphery of the fixed side attracting face 42 of the fixed core 22, thus forming an annular chamber 45 between the annular depression 44 and the outer periphery of a rear portion of the movable core 18.

Furthermore, a center hole 46 is formed in the inner periphery of the cylindrical non-magnetic body 26 forward of the annular depression 44, the center hole 46 having an inner diameter that is larger than the outer diameter of the fixed side attracting face 42, and the inner periphery of the cylindrical magnetic body 9 is provided with a guide hole 47 that has a larger diameter than that of the guide hole 14 of the valve seat member 10 so that the guide hole 47 is flush with the center hole 46.

On the other hand, the movable side attracting face 41, which has substantially the same outer diameter as that of the fixed side attracting face 42, is formed on the rear end face of the movable core 18, and this movable core 18 is formed from a tubular sliding portion 18*a* having an outer peripheral face that is in sliding contact with an inner face of the guide hole 47, which is an inner peripheral face of the rear portion of the cylindrical magnetic body 9, over a predetermined length L along the axis of the cylindrical magnetic body 9, a rear tubular opposing portion 18*b* that has the movable side attracting face 42 at its rear end, is connected coaxially and integrally to the rear end of the tubular sliding portion 18*a*, and has the outer periphery thereof facing the inner periphery of the cylindrical non-magnetic body 26, and a front tubular opposing portion 18*c* that has the outer periphery thereof facing the inner periphery of the guide hole 47, which is the inner periphery of the cylindrical magnetic body 9, and is connected coaxially and integrally to the front end of the tubular sliding portion 18*a*.

Moreover, when the diameter of the rear tubular opposing portion 18*b* is D1, the diameter of the front tubular opposing portion 18*c* is D2, and the diameter of the tubular sliding portion 18*a* is D3, they are set so that D1<D2<D3, and the predetermined length L is set to be equal to or less than 1 mm.

Furthermore, D1 to D3 are set so as to satisfy (D3−D2)/(D3−D1)≦0.5, and in order to satisfy this condition (D3−D2) is for example 0.036 to 0.056 mm, and (D3−D1) is for example 0.086 to 0.112 mm. By so doing, the difference in level between the outer periphery of the front tubular opposing portion 18*c* and the outer periphery of the tubular sliding portion 18*a* is 0.018 to 0.028 mm whereas the difference in level between the outer periphery of the rear tubular opposing portion 18*b* and the outer periphery of the tubular sliding portion 18*a* is 0.043 to 0.056 mm, and the distance between the front tubular opposing portion 18*c* and the cylindrical magnetic body 9 is no more than half the distance between the rear tubular opposing portion 18*b* and the cylindrical non-magnetic body 26.

Furthermore, the movable side attracting face 42 is formed at the rear end of the rear tubular opposing portion 18*b* at substantially right angles to the outer peripheral face of the rear tubular opposing portion 18*b*, and when the diameter of the fixed side attracting face 42 at the front end of the fixed core 22 is D4, it is set so that D1≦D4.

Moreover, the valve assembly 17 formed integrally from the movable core 18 and valve body 20, and the cylindrical magnetic body 9 are formed from a high hardness ferrite magnetic material, and the valve body 20 is provided with a journal portion 20*a* that is fitted slidably into the inner peripheral face of the valve seat member 10, that is, the guide hole 14.

The operation of this embodiment is now explained. The movable core 18 is formed from the tubular sliding portion 18*a*, which has the outer peripheral face that is in sliding contact with the inner peripheral face of the rear portion of the cylindrical magnetic body 9 over the predetermined length L along the axis of the cylindrical magnetic body 9, the rear tubular opposing portion 18*b*, which has the movable side attracting face 42 at its rear end, is connected coaxially and integrally to the rear end of the tubular sliding portion 18*a*, and has the outer periphery thereof facing the inner periphery of the cylindrical non-magnetic body 26, and the front tubular opposing portion 18*c*, which has the outer periphery thereof facing the inner periphery of the cylindrical magnetic body 9 and is connected coaxially and integrally to the front end of the tubular sliding portion 18*a*, and when the diameter of the rear tubular opposing portion 18*b* is D1, the diameter of the front tubular opposing portion 18*c* is D2, and the diameter of the tubular sliding portion 18*a* is D3, they are set so that D1<D2<D3.

In accordance with the movable core 18 having such a shape, the tubular sliding portion 18*a* is in sliding contact with the inner peripheral face of the cylindrical magnetic body 9 over the predetermined length L along the axis of the cylindrical magnetic body 9, a side gap between the movable core 18 and the cylindrical magnetic body 9 thus becomes substantially '0' in part and, furthermore, since the diameter D1 of the rear tubular opposing portion 18*b*, which forms part of the movable core 18 so that the outer periphery thereof faces the inner periphery of the cylindrical non-magnetic body 26, is smaller than the diameter D2 of the front tubular opposing portion 18*c*, which forms part of the movable core 18 so that the outer periphery thereof faces the inner periphery of the cylindrical magnetic body 9, it is possible to enhance the efficiency of passing magnetic flux between the movable core 18 and the cylindrical magnetic body 9 and improve the valve-opening responsiveness.

Furthermore, since the predetermined length L is set to be equal to or less than 1 mm, the tubular sliding portion 18*a* is in sliding contact with the inner peripheral face of the rear portion of the cylindrical magnetic body 9 over the relatively short length of equal to or less than 1 mm, thereby reducing to a low level the magnetic holding power generated between the cylindrical magnetic body 9 and the movable core 18 after stopping energization, and it is thus possible to avoid a deterioration in the valve-closing responsiveness. Moreover, the length of the front tubular opposing portion 18*c* is made relatively long, thus making it easy to maintain a constant side gap between the front tubular opposing portion 18*c* and the cylindrical magnetic body 9, and it is thereby possible to prevent variations in individual performance from being caused and to avoid as far as possible variations in the side gap affecting the valve-closing responsiveness.

Furthermore, since the diameter D1 of the rear tubular opposing portion 18*b*, the diameter D2 of the front tubular opposing portion 18*c*, and the diameter D3 of the tubular sliding portion 18*a* are set so as to satisfy (D3−D2)/(D3−D1)≦0.5, the distance between the front tubular opposing portion

18*c* and the cylindrical magnetic body 9 is made to be no more than half the distance between the rear tubular opposing portion 18*b* and the cylindrical non-magnetic body 26, thus enabling the outer periphery of the front tubular opposing portion 18*c* to be made closer to the inner periphery of the cylindrical magnetic body 9 and thereby yet further improving the valve-opening responsiveness.

Furthermore, since the movable side attracting face 41, which faces the fixed side attracting face 42 at the front end of the fixed core 22, is formed at the rear end of the rear tubular opposing portion 18*b* at substantially right angles to the outer peripheral face of the rear tubular opposing portion 18*b*, and when the diameter of the fixed side attracting face 42 is D4, it is set so that D1≦D4, the magnetic flux is passed between the fixed core 22 and the movable core 18 efficiently even when the axis of the movable core 18 is eccentric to the axis of the fixed core 22, thus enabling the area of the movable side attracting face 41 to be utilized effectively and thereby enhancing the attracting force with which the movable core 18 is attracted to the fixed core 22.

Moreover, since the movable core 18 and the valve body 20 are formed integrally from a high hardness ferrite magnetic material and the cylindrical magnetic body 9 is formed from a high hardness ferrite magnetic material, it is unnecessary to subject the movable core 18 and the cylindrical magnetic body 9 to a surface treatment such as chromium plating, and no non-magnetic film that would be formed by the surface treatment is formed; it is thus possible to yet further enhance the efficiency with which the magnetic flux is passed between the movable core 18 and the cylindrical magnetic body 9, enhance the attracting force for the movable core 18, and markedly improve the valve-opening responsiveness, and this is advantageous in terms of production cost.

Moreover, since the valve assembly 17 is in sliding contact at two axially separated positions with the valve seat member 10 and the cylindrical magnetic body 9, which form the valve housing 8, as a result of the journal portion 20*a* provided on the valve body 20 being slidably fitted into the inner peripheral face of the valve seat member 10, the axis of the valve assembly 17 can be prevented as far as possible from tilting within the valve housing 8, thus enabling a small and substantially uniform side gap to be set along the entire periphery between the movable core 18 and the cylindrical magnetic body 9, the efficiency in passing the magnetic flux to be enhanced, and the valve-opening responsiveness to be improved.

An embodiment of the present invention is explained above, but the present invention is not limited to the above-mentioned embodiment and can be modified in a variety of ways without departing from the spirit and scope of the present invention described in the claims.

The invention claimed is:

1. An electromagnetic fuel injection valve comprising: a valve housing (8) comprising a valve seat member (10) having a valve seat (13) and a cylindrical magnetic body (9) having a front end thereof coaxially connected to the valve seat member (10); a valve assembly (17) comprising a valve body (20) housed in the valve housing (8) so that the valve body (20) can be seated on the valve seat (13) and a movable core (18) coaxially connected to the valve body (20) with a rear end face of the movable core (18) as a movable side attracting face (41), the valve assembly (17) being spring-biased in a direction that seats the valve body (20) on the valve seat (13); a cylindrical non-magnetic body (26) having the front end thereof coaxially joined to the rear end of the cylindrical magnetic body (9) so as to surround a part of the movable core (18); and a fixed core (22) having at a front end thereof a fixed side attracting face (42) facing the movable side attracting face (41) and having a front portion thereof fitted into and fixed to a rear portion of the cylindrical non-magnetic body (26); characterized in that the movable core (18) comprises a tubular sliding portion (18*a*) having an outer peripheral face that is in sliding contact with an inner peripheral face of a rear portion of the cylindrical magnetic body (9) over a predetermined length along the axis of the cylindrical magnetic body (9), a rear tubular opposing portion (18*b*) that has the movable side attracting face (41) at a rear end thereof, is connected coaxially and integrally to the rear end of the tubular sliding portion (18*a*), and has the outer periphery thereof facing the inner periphery of the cylindrical magnetic body (9), and a front tubular opposing portion (18*c*) that has the outer periphery thereof facing the inner periphery of the cylindrical magnetic body (9) and is connected coaxially and integrally to the front end of the tubular sliding portion (18*a*), and when the diameter of the rear tubular opposing portion (18*b*) is D1, the diameter of the front tubular opposing portion (18*c*) is D2, and the diameter of the tubular sliding portion (18*a*) is D3, they are set so that D1<D2<D3.

2. The electromagnetic fuel injection valve according to claim 1, wherein the predetermined length is set to be equal to or less than 1 mm.

3. The electromagnetic fuel injection valve according to either claim 1 or 2, wherein the diameter D1 of the rear tubular opposing portion (18*b*), the diameter D2 of the front tubular opposing portion (18*c*), and the diameter D3 of the tubular sliding portion (18*a*) are set so as to satisfy (D3−D2)/(D3−D1)≦0.5.

4. The electromagnetic fuel injection valve according to either claim 1 or 2, wherein the movable side attracting face (41) is formed at the rear end of the rear tubular opposing portion (18*b*) at substantially right angles to the outer peripheral face of the rear tubular opposing portion (18*b*), and when the diameter of the fixed side attracting face (42) is D4, it is set so that D1≦D4.

5. The electromagnetic fuel injection valve according to either claim 1 or 2, wherein the movable core (18) and the valve body (20) are formed integrally from a high hardness ferrite magnetic material, the cylindrical magnetic body (9) is formed from a high hardness ferrite magnetic material, and a journal portion (20*a*) provided in the valve body (20) is slidably fitted into an inner peripheral face of the valve seat member (10).

* * * * *

UNITED STATES PATENT AND TRADEMARK OFFICE

CERTIFICATE OF CORRECTION

PATENT NO. : 7,581,711 B2
APPLICATION NO. : 11/579386
DATED : September 1, 2009
INVENTOR(S) : Akira Akabane It is certified that error appears in the above-identified patent and that said Letters Patent is hereby corrected as shown below:

On the Title Page

~~Item (22) PCT Filed: Oct. 6, 2005~~ should read as:

Item (22) PCT filed: Jun. 10, 2005

Signed and Sealed this
Twenty-second Day of July, 2014

Michelle K. Lee

Michelle K. Lee
*Deputy Director of the United States Patent and Trademark Office*